US005506554A

United States Patent [19]

Ala-Kojola

[11] Patent Number: 5,506,554

[45] Date of Patent: Apr. 9, 1996

[54] DIELECTRIC FILTER WITH INDUCTIVE COUPLING ELECTRODES FORMED ON AN ADJACENT INSULATING LAYER

[75] Inventor: Jouni Ala-Kojola, Oulu, Finland

[73] Assignee: LK-Products OY, Kempele, Finland

[21] Appl. No.: 271,889

[22] Filed: Jul. 5, 1994

[30] Foreign Application Priority Data

Jul. 2, 1993 [FI] Finland ..... 933056

[51] Int. Cl.[6] ..... H01P 1/205

[52] U.S. Cl. ..... 333/206; 333/222

[58] Field of Search ..... 333/202, 203, 333/206, 207, 222

[56] References Cited

U.S. PATENT DOCUMENTS

| | | | |
|---|---|---|---|
| 4,891,612 | 1/1990 | Gleason et al. | 333/33 |
| 5,045,824 | 9/1991 | Metroka | 333/206 |
| 5,103,197 | 4/1992 | Turunen et al. | 333/206 |
| 5,144,269 | 9/1992 | Itoh | 333/206 |
| 5,208,565 | 5/1993 | Sogo et al. | 333/206 |
| 5,239,219 | 8/1993 | Turunen et al. | 333/206 X |
| 5,365,209 | 11/1994 | Ito et al. | 333/206 |
| 5,402,090 | 3/1995 | Shimizu et al. | 333/206 |

FOREIGN PATENT DOCUMENTS

| | | | |
|---|---|---|---|
| 0401839 | 12/1990 | European Pat. Off. . | |
| 0444948 | 9/1991 | European Pat. Off. . | |
| 0506340A3 | 9/1993 | European Pat. Off. . | |
| 0595623 | 5/1994 | European Pat. Off. | 333/206 |
| 87406 | 5/1994 | Finland . | |
| 0167308 | 7/1993 | Japan | 333/206 |
| 2258348 | 2/1993 | United Kingdom . | |

*Primary Examiner*—Benny Lee
*Assistant Examiner*—Justin P. Bettendorf
*Attorney, Agent, or Firm*—Darby & Darby

[57] ABSTRACT

The present invention relates to a radio frequency filter, comprising a block(1) of a dielectric agent and an insulation sheet (2) attached to a side surface thereof. From the top surface of the block to the undersurface, at least two holes (3,4,5) coated with a conductive agent extend. At least most of the surface of the body, with the exception of one side surface, as well as the surfaces of the holes have been coated with a conductive agent, whereby a transmission line resonator is produced for each hole. The surface of the insulation sheet (2) fixed against the uncoated side surface but not facing the block has also been coated with a conductive agent. The coupling pattern formed by the metallic electrodes is located between the opposite surfaces. The unevenness of the surfaces placed against each other and the defects in adjusting the pieces cause great divergence in the response curves of the filters. This can be reduced in that prior to attaching the insulation sheet (2) part (14,15,16,17, 115) of the electrodes of the coupling pattern have been arranged on the uncoated side surface of the insulation sheet (2) and the rest (7,8,9,10,11,12,13,114) of the electrodes of the coupling pattern have been arranged on the other side surface of the body.

10 Claims, 2 Drawing Sheets

DIELECTRIC FILTER WITH INDUCTIVE COUPLING ELECTRODES FORMED ON AN ADJACENT INSULATING LAYER

BACKGROUND OF THE INVENTION

The present invention relates to radio frequency filters of the type comprising a block of dielectric matter and an insulation sheet. The surfaces of the block comprise a top surface and bottom surface on the opposite sides, two opposite side surfaces limited to said surfaces, and the opposite two end surfaces. From the top surface of the block to the bottom surface at least two holes extend, coated with a conductive material. At least the main part of the surface of the body, with the exception of one side surface, has been coated with a conductive layer, whereby a transmission line resonator is produced for each hole. The insulation sheet has been attached against the uncoated side surface, the surface of which not facing the block is coated with a conductive layer.

Known in the art are such dielectric, usually ceramic filters which have been coated all over, with the exception of the top surface, with an electrically conductive material. When the coating of a coated hole is connected with the coating of the bottom surface, the hole has been short circuited at that point. Since the top surface, at least in the vicinity of the hole, is uncoated, the hole is open at this end. The structure forms now a quarter-wave transmission line resonator. When conducting an electromagnetic wave into the structure, at a given frequency, i.e. at the resonant frequency, a standing wave in the direction of the hole is produced. The maximum of the capacitive field thereof is placed at the open end of the hole, whereas the maximum of the inductive field is placed at the short circuited hole. If on the uncoated top surface various conductive patterns are placed, both the resonant frequency of an individual resonator and the coupling between the resonators can be affected. By positioning a conductive pad adjacent to the open end of the furthermost resonators of the block, and insulated from the coating of the side of the block, a signal can be carried into the resonator by being capacitively coupled with the resonator, and out therefrom likewise by capacitive coupling. Since between the coating of the open top end of the resonator and the coating of the top side edge of the ceramic block is a given capacitance value, said capacitance can be changed by adding some coating to the proximity of the top side hole,said coating being in connection with the coating of the side, or by adding some coating on the top side in connection with the coating of the hole. This is one manner in which the resonant frequency is affected. With the aid of the conductive patterns, capacitors and transmission lines may further be arranged on the top surface also between the resonators, and so, the coupling between the resonators can be affected.

The inductive coupling between the resonators can be affected by handling the ceramic block, e.g. by boring holes therein or by removing otherwise some of the matter.

Positioning conductive patterns on the top surface of the ceramic block is, however, very difficult because the surface area available is very small, so that even minimal defects in the accuracy in positioning the conductor patterns greatly affect the electrical properties of the filter. In addition, by placing the conductive patterns merely on the top surface, only the capacitive field can be affected, and the couplings are therefore capacitive.

A critical improvement in said generally used method is disclosed in the patent application EP-0 401 839 of the present applicant, Turunen et al., whose U.S. counterpart issued as U.S. Pat. No. 5,103,197. In the filter described therein the electrical properties of the filter can be affected in a wide range in that the side surface is substantially uncoated, and the conductive patterns and the coupling wires have been placed on said side surface of the filter block. Not only is the surface area available much larger for positioning the conductive patterns than in placing them on the top surface, but also the inductive coupling between the resonators can be affected. It is true that the inductive field is largest in the short circuited lower end of the resonator. Positioning a conductive pattern on a side surface allows making the coupling between the resonators capacitive, inductive and capacitively-inductive in one and same filter block. Also the coupling to the filter can be performed inductively, capacitively and as a combination thereof. The electrical properties of the filter are not so sensitive to minor variations in positioning the conductive patterns on a block side as they are when the patterns are positioned on the top surface with a small surface area. According to the EP application, the side on which the conductive patterns are located, is finally coated with a metallic cover. Said filter construction allows considerable freedom for the filter designer, and in practice, by using merely a few standard-sized filter blocks, it is possible, by varying the bandwidth and the mean frequency of the resonators, that is, by using different conductive patterns, filters of different types can be constructed.

In the EP application, also another embodiment is described. As taught thereby, the side surface of the block is also substantially uncoated. An insulation sheet is placed against the side surface, the surface not facing said surface of the block as well as the edges of the sheet have been coated. The coating is electrically in connection with the coating of the block. The conductive patterns have therefore been placed on the surface of said insulation sheet positioned against the uncoated side surface of the ceramic block. This is preferable particularly when the insulation sheet is part of the circuit board whereon also the rest of the components required in the circuit are placed. Such discrete components can be, e.g. coils and surface mounted resistors. Since it is difficult to obtain high inductance values with the conductive patterns, discrete coils are needed in a variety of filters, such as band stop filters between different resonators through which a signal passes from one resonator to another. Said discrete components are placed on the part of the insulation sheet which extends across the side surface of the filter block. Carrying a signal into a filter as well as therefrom can be performed with strip conductors via said crossing part.

The construction according to the EP application mentioned above and particularly the embodiment in which the conductive patterns and coupling parts are placed on the insulation sheet positioned against the side surface contain serious drawbacks in spite of certain advantages. The first one is the requirement concerning the straightness of the surfaces. Both the side surface of the block and the insulation sheet placed thereagainst are required to be extremely plain so that no air gaps are left therebetween when the surfaces are placed one against the other. The second one concerns the requirement set on adjusting the insulation sheet. When the patterns are located on the insulation sheet and they must be positioned precisely on a given pad against the side surface of the block, even minor divergence in positioning generate variations in the electrical properties in the finished products, which may exceed the permitted tolerances.

SUMMARY OF THE INVENTION

In accordance with a first aspect of the present invention there is provided a radio frequency filter, comprising a block of a dielectric agent, in which the top and under surfaces are located on the opposite sides of the body, opposite end surfaces between said surfaces, and opposite side surfaces; at least two holes extending through the block from the top surface to the undersurface; an electrically conductive layer on the undersurface of the body, on both end surfaces and on a first side surface, and on the inner surface of the holes, whereby a transmission line resonator is produced for each hole; an insulation sheet, attached against one side surface of the block, and the surfaces whereof, with the exception of the side of said surface, have substantially been coated with a conductive layer; a coupling pattern formed by conductive electrodes to be coupled to the resonators when said coupling pattern is located mainly between the insulation sheet and the block; characterized in that prior to the attaching of the insulation sheet, part of the electrodes of the coupling pattern have been arranged on the uncoated side surface of the insulation sheet and the rest of the electrodes of the coupling pattern have been arranged on the other side surface of the body.

In accordance with a second aspect of the present invention there is provided a radio frequency filter comprising:

a dielectric block having a plurality of axially aligned resonance apertures extending between opposed end faces, each of the resonance apertures being coated on its internal surface with a conductive layer, such that together with an external conductive layer on the dielectric block a transmission line resonator is provided for each aperture; and an insulating layer arranged adjacent a side face of the dielectric block, characterised in that conductive regions provided adjacent the side face of the dielectric block for affecting the coupling between resonators are provided by first and second conductive patterns disposed one on each of the second face of the dielectric block and the facing surface of the insulating layer.

The present invention provides a filter which has the advantages of the structure described in the EP patent without the drawbacks. This is achieved by providing part of the conductive patterns on the uncoated side surface of the ceramic block and part on the side surface of the insulation sheet to be set against said surface. In addition, part of the patterns may be such that in the final installation they are placed at least partly one on top of the other.

By positioning the conductive patterns and pads on the side surface of the ceramic block in positioning whereof deviations are permitted, the requirements concerning the precision of assembly may be reduced. The mean frequency of the filter can be affected so that the same basic block is used in which the pattern of the side is kept the same but the pattern of the insulation sheet to be positioned against the side varies. Hereby, filters with different electrical properties can be produced using one and the same ceramic block, through the patterns of the side whereof majority of the couplings is performed, and by varying the insulation sheet.

BRIEF DESCRIPTION OF DRAWINGS

The invention and the various embodiments thereof are described with the aid of the accompanying exemplary figures, in which.

DETAILED DESCRIPTION OF A PREFERRED EMBODIMENT

Figure 1A:
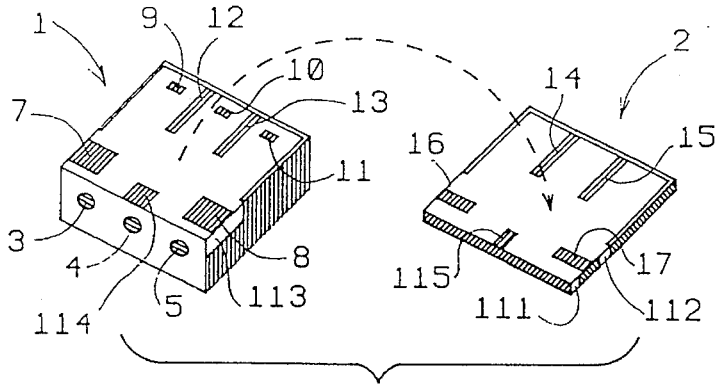
FIGS. 1A–C present a three-pole bandpass filter.

FIG. 1 presents a three-pole filter. It comprises two parts, a dielectric block 1 and an insulation sheet 2, FIG. 1A. The block is substantially rectangular, comprising a top surface and an bottom surface, two end surfaces, and two side surfaces. The block is provided with three holes 3,4 and 5 extending from the top surface to the bottom surface and coated with a conductive material, the openings whereof on the top surface are shown in the figure. The end surfaces of the block, one side surface and the bottom surface are also coated with a conductive material. The coated surfaces are shown in lines. The other side surface of the body, shown in FIG. 1A in its entirety, is not coated. The coating of the lower end of each of the holes is joined with the coating of the undersurface of the body, whereas the coating of the top end of the hole is insulated from the coating of the sides of the block. Thus, for each hole a transmission line resonator is produced, the length whereof being selected according to the desired response curve of the filter. For hole 5, resonator RES1 is produced, for hole 4, resonator RES2; respectively, for hole 3, resonator RES3, FIG. 2.

The substantially uncoated side surface of the block is provided with circuit patterns produced by metal-foil patterns for couplings to the transmission line resonators and for couplings between the resonators. The significance of said coupling patterns is described here, reference being made to FIG. 2, which presents the response connection of the filter of FIG. 1C. The pads 7 and 8 have been isolated from the coating of the side surfaces by means of insulation space 113. When a signal is carried to pad 8, it is capacitively coupled to resonator RES1. Respectively, a filtered signal is achieved from pad 7, which is coupled to the last resonator RES3, also by capacitive connection. Thus, between the pad 8 and the top end coating of hole 5 in resonator RES1 a capacitance C1 exists, FIG. 2. In addition, the side surface is provided with a pad 114 at the top end of resonator RES2, and at the lower end of each of the resonators, pads 9, 10 and 11. Between the resonators RES1 and RES2, and RES2 and RES3, strips 12, resp. 13, are moreover provided, one end thereof being in connection with the coating of the bottom.

The surface area and shape of the insulation sheet shown in FIG. 1A correspond to the surface area and shape of the side surface of the body. One side surface of the sheet as well as the edges are coated all over with a conductive agent. On the other side surface, visible in its entirety in the figure, circuit patterns have been arranged. The coating as well as the metallic circuit patterns are presented by lines. Pads 16 and 17 are isolated from the coating whereas pad 115 and strips 14 and 15 are at one end in connection with the coating.

Figure 2:
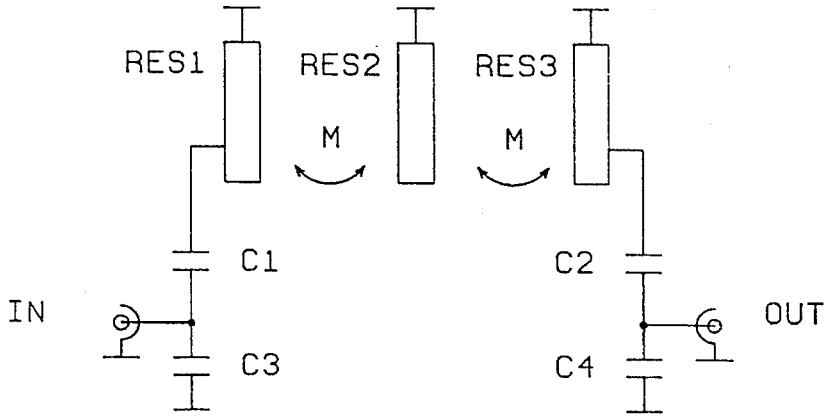
FIG. 2 shows a response circuit of the filter in FIG. 1, FIGS. 3A–C present a three-pole band stop filter.

When assembling a filter, an insulation sheet is placed against the ceramic block with the circuit pattern surfaces so against each other that the pads 17 and 7 are placed against each other, similarly as pads 16 and 8 are placed against each other. A signal is carried between the pads 8 and 16 e.g. on a strip conductor (not shown). When viewed from said pad, coupling to the filter is performed via the pad 8 of the capacitor and the capacitor C1 provided by the coating of hole 5 of resonator RES1 (FIG. 2). In addition, from said pad grounding is performed via pad 16 and the capacitor C3 provided by the coating of the insulation sheet 2 (FIG. 2). Respectively, when viewed from a point between the pads 7 and 17, capacitors C2 and C4 are formed, where between the filtered signal is conducted out with the aid of a strip line (not shown). Pad 114 on the side surface of the block is grounded via pad 115 of the insulation sheet, whereby pad 114, while forming a second capacitor electrode, charges capacitively the resonator RES2, so that the resonant frequency thereof is lower than without a charge. The strips 12 and 15, and 13 and 14 against each other are located between two resonators, affecting the inductive coupling between said resonators. The pads 9, 10 and 11 are not connected anywhere so that they exert no effect on the filter. Increasing the size of the pads 7 and 8 on the block increases the capacitance, thus widening the bandwidth of the filter, whereas increasing the size of the pads 16 and 17 on the insulation sheet diminishes the band-width.

Figure 1B:
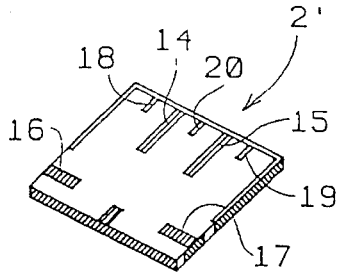
Figure 1C:
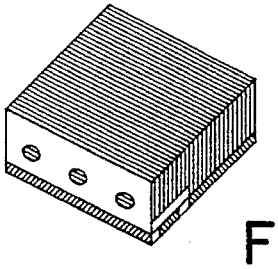

After placing the block and the insulation sheet against one another and fastening to each other e.g. by soldering, a filter such as the one shown in FIG. 1C is obtained. In said coupling patterns it is a three-circuit bandpass filter. It is to be noted that the shape or amount of the coupling patterns bear as such no significance as regards the present invention.

On the block as in FIG. 1A an insulation sheet of FIG. 1B may be also attached, instead of the insulation sheet as in FIG. 1A. The difference between the sheets lies in that the latter one is moreover provided with metal strips 18, 19 and 20 connected to the coating of the edge. When a sheet is placed against the body, as described above, the pads 9, 10 and 11 on the inductive end of the resonators of the block are grounded. Therethrough, the resonant frequency of the resonators increases and the entire filter is tuned upwards in the frequency.

Figures 3A, 3B:
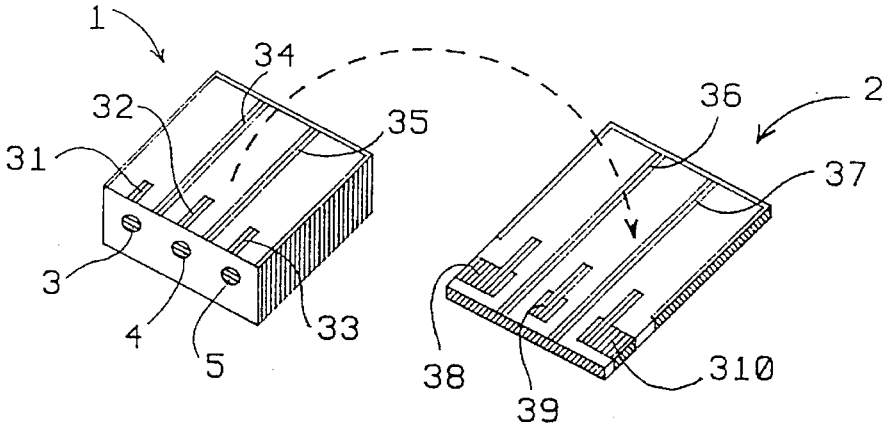
Figure 3C:
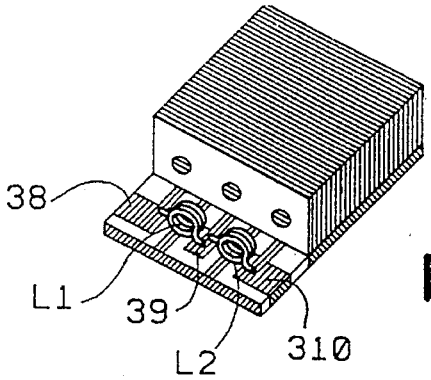
Figure 4:
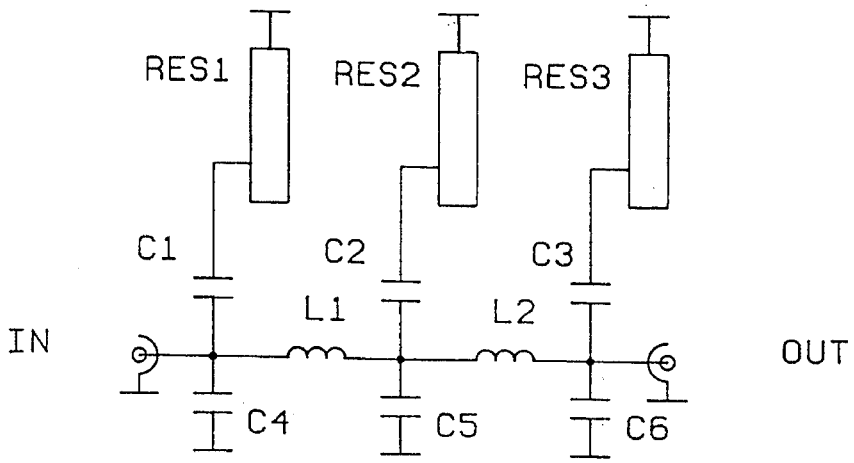
FIG. 4 presents the response circuit of the filter shown in FIG. 3.

FIG. 3 presents a three-pole stop band filter in which the coupling patterns are used as taught by the invention, both on the side surface of the block and on the surface of the insulation sheet. FIG. 4 presents a response circuit of the filter. Merely by the aid of said circuit patterns and two discrete components, said filter can be constructed although the dimensions of the block and the insulation sheet are the same as in a three-pole band pass filter. On the side surface of the block 1, pads 31, 32 and 33 are located at the top end of the resonators, from which the coupling to each resonator takes place. Between the resonators strips 34 and 35 travel on the length of the entire side, one end whereof being connected to the coating of the bottom surface. On the uncoated surface of the insulation sheet 2, FIG. 3B, a coupling pattern is located, comprising pads 38,39 and 310, and two strips 36 and 37 extend from one end of the surface to the other, both ends whereof being joined to the coating of the sheet edge. The insulation sheet acts at the same time as a coupling sheet for coils L1 and L2 (FIG. 3C), which are soldered to pads 38,39 and 310 in the manner shown in the figure. The insulation sheet is attached e.g. by soldering to the block with the coupling pattern surfaces against each other so that the finger-like projections of the pads 38, 39 and 310 on the insulation sheet enter on top of the equivalent pads 31, 32 and 33 of the body. The longitudinal strips 36 and 37 are placed on top of the equivalent strips 32 and 35 of the body. The complete filter is shown in FIG. 3C. Part of the insulation sheet, being in the direction of the resonators longer in dimension than the body, remains, as shown in FIG. 3C, as a flange, whereon the pads 38,39 and 310 are mainly visible. It is easy to fasten the coils L1 and L2 on said pads, and the input connection wire (not shown) to pad 310 and the output connection wire to pad 38.

FIG. 4 presents a response circuit of a filter. The longitudinal strip pairs 34, 37 and 35,36 provide a complete isolation of the resonators from one another via the ceramic block by cancelling the electrical and magnetic field at the strip, whereby the signal moves from the resonator RES1 to resonator RES2 only via coil L1, and from resonator RES2 to resonator RES3 only via coil L2. The capacitances C4, C5 and C6 are formed from the capacitor formed by the pads 38,39 and 310 and the coating of one side of the insulation sheet. Respectively, the capacitances C1, C2 and C3 are composed of a capacitor formed by pads 33,32 and 31 and holes 5,4 and 3. So, coupling to the resonators is performed capacitively.

The embodiment shown in FIG. 3 is highly advantageous because various discrete components can be placed with ease on the flange projecting from the block 1 of the insulation sheet 2, depending on the filter. Therefore, it is obvious to a person skilled in the art to prepare e.g. a duplex filter using a single ceramic body. The filters of the Rx and Tx branch are separated in equivalent manner using a corresponding strip extending over the surface wherewith the individual resonators in the design shown in FIG. 3 were separated. The discrete components required can be positioned on the flange. It is obvious to a person skilled in the art that, if desired, said flange part can be covered with a separate metal cover.

When the coupling patterns are placed as taught by the invention on both the side surface of the block and the flange, numerous advantages are gained.

Using the same block but varying the insulation sheet to be attached thereto, the response curve of the filter can be changed with ease. Inserting the discrete components in the filter circuit is also easy when the surface area of the insulation sheet greater than the surface area of one side of the body.

While remaining within the protective scope of the invention, the most diverse filters can be implemented. No restrictions are set for the requirements to meet concerning the shape and number of circuit patterns, or external components possibly used. The insulation sheet may also be part of the circuit board, whereto the radio frequency parts of the radio apparatus have been attached. It may also be smaller in the surface area than the surface area of the side surface of the body.

What is claimed is:

1. A radio frequency filter comprising:

a dielectric block having first and second opposed end faces and a side face, the dielectric block defining a plurality of axially aligned resonance apertures extending between said opposed end faces, each of the plurality of resonance apertures being coated on an internal surface with a conductive layer;

an external conductive layer disposed on the dielectric block whereby a transmission line resonator is provided for each aperture, and one of the first and second end faces of the dielectric block being covered by the external conductive layer;

an insulating layer having a facing surface arranged adjacent said side face of the dielectric block, said insulating layer facing surface extending to said one of the first and second end faces of the dielectric block which is covered by the external conductive layer; and first and second conductive coupling electrodes disposed respectively on the side face of the dielectric block and the facing surface of the insulating layer for affecting at least the inductive coupling between resonators from the side face of the dielectric block adjacent the insulating layer.

2. A radio frequency filter according to claim 1 wherein the insulating layer extends beyond the dielectric block adjacent one of the opposed end faces.

3. A radio frequency filter according to claim 1, wherein at least one of said first and second conductive coupling electrodes are disposed at or in close proximity to said one of the first and second end faces of the dielectric block which is covered by the external conductive layer.

4. A radio frequency filter according to claim 1 wherein the first and second conductive patterns are arranged such that they overlap each other to provide the conductive regions.

5. A radio frequency filter according to claim 1 wherein the external conductive layer covers the dielectric block completely except for one end face and the side face.

6. A radio frequency filter, comprising:

a block of a dielectric agent, having opposed top and bottom surfaces, opposed first and second end surfaces extending between said top and bottom surfaces, and opposed first and second side surfaces, the block defining at least two holes extending through the block from the top surface to the bottom surface, an electrically conductive layer on the bottom surface of the block, on said first and second end surfaces and on said first side surface, and on an inner surface of each said hole, whereby a transmission line resonator is produced for each hole, an insulation sheet, attached against the second side surface of the block having surfaces with a particular surface area with a particular shape, said sheet having a side surface that is substantially coated with a conductive layer and an uncoated side surface that is uncoated and is attached against the second side surface of the block, a coupling pattern formed by conductive coupling electrodes to be at least inductively coupled to the resonators from the second side of the dielectric block facing the insulation sheet when said coupling pattern is located mainly between the insulation sheet and the block, and part of the electrodes of the coupling pattern are arranged on the uncoated side surface of the insulation sheet and the rest of the electrodes of the coupling pattern are arranged on the second side surface of the block, and the surface area and shape of the insulation sheet, and the surface area and shape of the second side surface of the block being substantially similar, and the uncoated side surface of the insulation sheet extending to the bottom surface of the block while being attached against the second side surface of the block.

7. A radio frequency filter according to claim 6, wherein said conductive coupling electrodes are located at or in close proximity to the bottom surface of the block.

8. Filter according to claim 6, wherein the surface area of the insulation sheet is larger than the surface area of the second side surface area of the block.

9. Filter according to claim 8, wherein the part of the insulation sheet attached to the second side surface of the block forms a flange-like projection where it extends beyond the second side surface of the block, whereon discrete components of the filter are attached.

10. Filter according to claim 6, wherein at least part of the electrodes of the insulation sheet are placed in contact with the electrodes on the second side surface of the block.

* * * * *